US007042415B2

(12) United States Patent
Cheng

(10) Patent No.: US 7,042,415 B2
(45) Date of Patent: May 9, 2006

(54) DUAL BAND AND BROADBAND FLAT DIPOLE ANTENNA

(75) Inventor: Shih-Chieh Cheng, Yongkang (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/011,079

(22) Filed: Dec. 15, 2004

(65) Prior Publication Data

US 2006/0022888 A1 Feb. 2, 2006

(30) Foreign Application Priority Data

Jul. 30, 2004 (TW) ..... 93123039 A

(51) Int. Cl.
*H01Q 9/16* (2006.01)

(52) U.S. Cl. ..... 343/795; 343/793; 343/801; 343/806; 343/812

(58) Field of Classification Search ..... 343/795, 343/793, 801, 806, 812
See application file for complete search history.

(56) References Cited

U.S. PATENT DOCUMENTS 6,621,464 B1 * 9/2003 Fang et al. ..... 343/795
6,624,793 B1 * 9/2003 Su et al. ..... 343/795

* cited by examiner

*Primary Examiner*—Trinh V. Dinh
*Assistant Examiner*—Chuc Tran
(74) *Attorney, Agent, or Firm*—Bacon & Thomas, PLLC

(57) ABSTRACT

A dual band and broadband flat dipole antenna comprises a first radiating body, a second radiating body, and a conductivity element. The first radiating body has two first frequency-radiating parts, two second frequency-radiating parts, and a first electrically connecting part. The first and second frequency-radiating parts are extended from a side of the first electrically connecting part. The second frequency-radiating parts are disposed between the first frequency-radiating parts. The second radiating body similar to the first radiating body has two first frequency-radiating parts, two second frequency-radiating parts, and a second electrically connecting part. The first and second frequency-radiating parts are extended from a side of the second electrically connecting part with the direction reversing to the extending direction of the first radiating body. The conductivity element has a conductivity body and a grounding conductor electrically connected with the first electrically connecting part and the second electrically connecting part, respectively.

11 Claims, 3 Drawing Sheets

DUAL BAND AND BROADBAND FLAT DIPOLE ANTENNA

BACKGROUND OF THE INVENTION

1. Field of Invention

The invention relates to an antenna and, in particular, to a dual band and broadband flat dipole antenna, which can increase the operation bandwidth of the antenna for applications in more countries or areas.

2. Related Art

The prosperous development of wireless transmission industry has carried out various products and techniques for multi-band transmission, so that many new products have the wireless transmission function so as to meet the consumer's demands.

The antenna, which is used for radiating or receiving the electromagnetic wave, is an important component in the wireless transmission system. The wireless transmission system would not work normally such as radiating or receiving data if it lack of the antenna. Therefore, the antenna is indispensable in the wireless transmission system.

Choosing the suitable antenna not only can be contributive to collocate the appearance of product and to increase transmission characteristics, but also can decrease the production cost. Since the designing method and manufacturing materials are different when designing the antenna for varied application products, and the working frequency band are different in different countries, it is very critical for designing the antenna.

At present, the common specification of frequency band are the IEEE 802.11 and the IEEE 802.15.1 (Bluetooth communication) etc, wherein the Bluetooth communication is worked at frequency band of 2.4 GHz. The 802.11 includes 802.11a and 802.11b standards, which are defined for the frequency band of 5 GHz and 2.4 GHz, respectively.

Referring to FIG. 1, a conventional dual band and dual dipole antenna includes two rectangular radiating metal sheets 11 and 12, and a coaxial line 13. The radiating metal sheets 11 and 12 have corresponding feeding points 111 and 121, and inverted-L splits 112 and 122, respectively. The feeding points 111 and 121 are electrically connected with the coaxial line 13, respectively. The rectangular metal sheets 11 and 12 are divided into a high frequency mode and a low frequency mode by the inverted-L splits 112 and 122, wherein the high frequency mode is from 5.15 GHz to 5.35 GHz, and the low frequency mode is from 2.4 GHz to 2.484 GHz.

However, there has different usable frequency band in different countries, especially to the IEEE 802.11a standard. The component of the antenna must adapt to the range of different bandwidth, and, for example, the output must be a high frequency band (5.47–5:725 GHz), 1 watt to adapt for all country channels in the Europe.

As mentioned above, the conventional dipole antenna only covers a part of the bandwidth, and the dipole antenna for application products, therefore, is unable to be applied in different countries because the available bandwidth is probably restricted in different countries or areas.

It is therefore a subjective of the invention to increase the operation bandwidth of a dipole antenna to adapt to the requirement for more country areas.

SUMMARY OF THE INVENTION

In view of the above, the invention is to provide a dual band and broadband flat dipole antenna, which can increase the working bandwidth and can be simultaneously applied in two different frequency bands.

To achieve the above, a dual band and broadband flat dipole antenna of the invention includes a first radiating body, a second radiating body, and a conductivity element.

The first radiating body has at least two first frequency-radiating parts, at least two second frequency-radiating parts, and a first electrically connecting part. The first frequency-radiating parts of the first radiating body and the second frequency-radiating parts of the first radiating body are extended from a side of the first electrically connecting part. The second frequency-radiating parts of the first radiating body are disposed between the first frequency-radiating parts of the first radiating body.

The second radiating body has at least two first frequency-radiating parts, at least two second frequency-radiating parts, and a second electrically connecting part. Each first frequency-radiating part of the first radiating body and the second radiating body has a first length and a first width, and each second frequency-radiating part of the first radiating body and the second radiating body has a second length and a second width. The first frequency-radiating parts of the second radiating body and the second frequency-radiating parts of the second radiating body are extended from a side of the second electrically connecting part with a direction reversing to an extending direction of the first radiating body. The second frequency-radiating parts of the second radiating body are disposed between the first frequency-radiating parts of the second radiating body.

The conductivity element has a conductivity body and a ground conductor. The conductivity body and the ground conductor are electrically connected with the first electrically connecting part and the second electrically connecting part, respectively.

As mentioned above, the dual band and broadband flat dipole antenna of the invention utilizes the first frequency-radiating parts and the second frequency-radiating parts to achieve the function of dual band and to achieve the function of broadband according to the structure and the configuration of the first radiating body and the second radiating body. Therefore, the usable range of bandwidth of the application products with the antenna of the invention is broadened, so that the application products with the antenna can be used in more countries.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The dual band and broadband flat dipole antenna of the invention will be apparent from the following detailed description, which proceeds with reference to the accompanying drawings, wherein the same references relate to the same elements.

Figure 1:
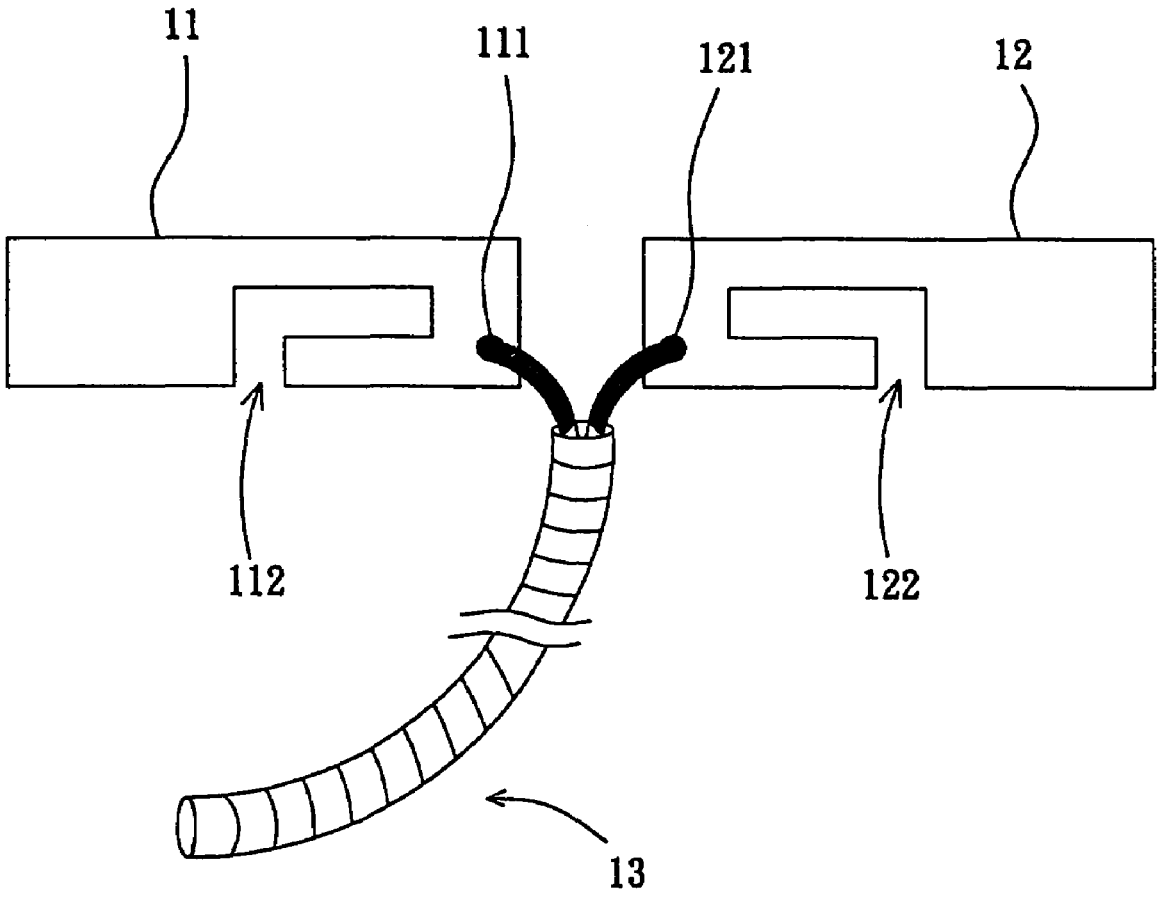
PRIOR ART FIG. 1
FIG. 1 is a schematic diagram showing a conventional dipole antenna.
Figure 2:
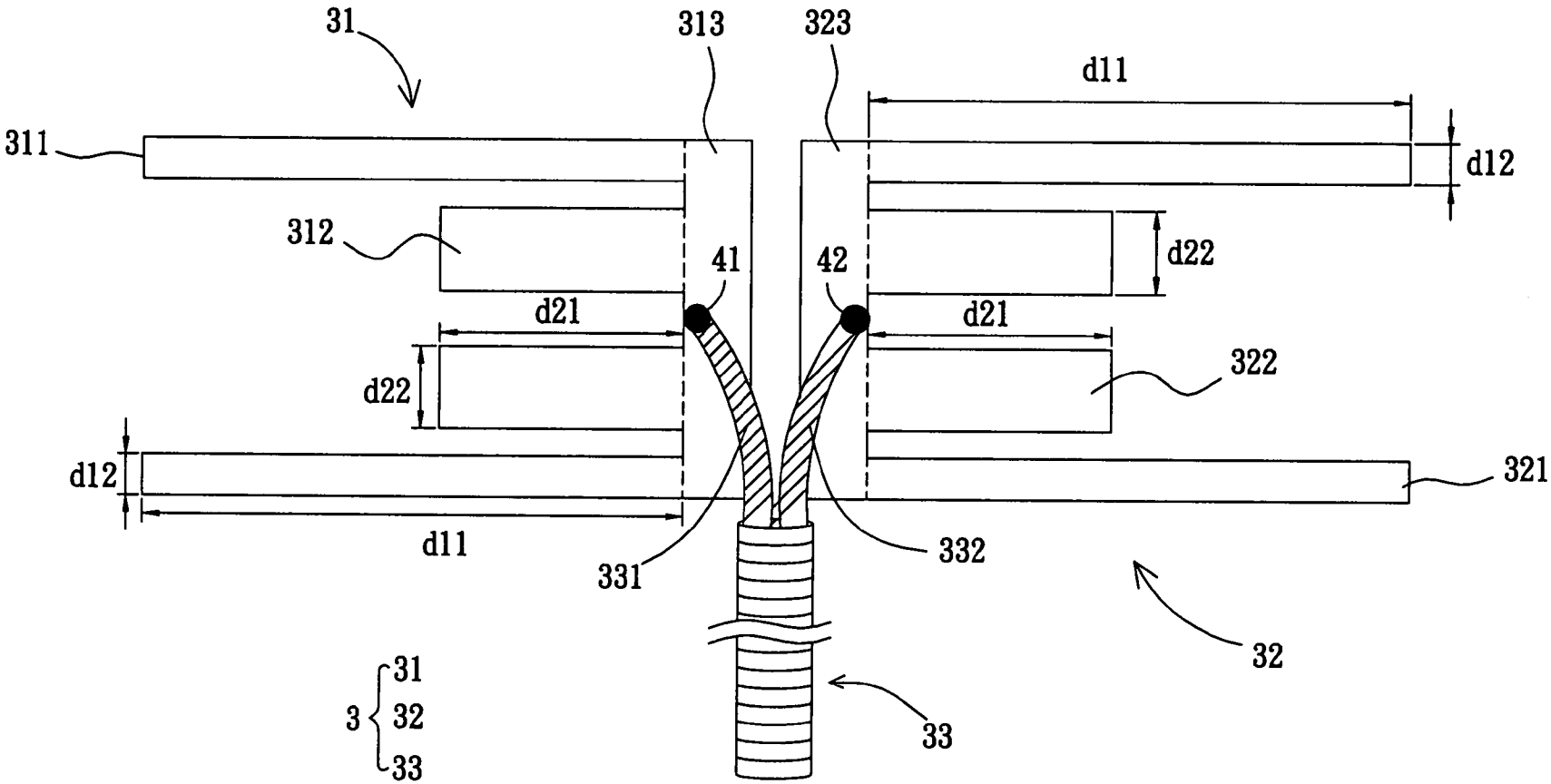
FIG. 2 is a schematic diagram showing a dual band and broadband flat dipole antenna according to an embodiment of the invention.

Referring to FIG. 2, a dual band and broadband flat dipole antenna 3 according to an embodiment of the invention includes a first radiating body 31, a second radiating body 32, and a conductivity element 33.

The first radiating body 31 has at least two first frequency-radiating parts 311, at least two second frequency-radiating parts 312, and a first electrically connecting part 313. In the embodiment, the first frequency-radiating parts 311 and the second frequency-radiating parts 312 are rectangular.

Each the first frequency-radiating part 311 has a first length d11 and a first width d12. Each second frequency-radiating part 312 has a second length d21 and a second width d22. The second width d22 is greater than or equal to twice of the first width d12, and the first length d11 is between one and three times of the second length d22. In this embodiment, the second width d22 is equal to twice of the first width d12.

The first frequency-radiating parts 311 and the second frequency-radiating parts 312 are extended from a side of the first electrically connecting part 313, and the second frequency-radiating parts 312 are disposed between the first frequency-radiating parts 311.

The second radiating body 32, which is similar to the first radiating body 31, has at least two first frequency-radiating parts 321, at least two second frequency-radiating parts 322, and a second electrically connecting part 323. In this embodiment, each first frequency-radiating part 321 and each second frequency-radiating part 322 are rectangular. Similarly, each first frequency-radiating part 321 has a first length d11 and a first width d12, and each second frequency-radiating part 322 has a second length d21 and a second width d22.

The first frequency-radiating parts 321 and the second frequency-radiating parts 322 are extended from a side of the second electrically connecting part 323 with a direction reversing to an extending direction of the first radiating body 31. The second frequency-radiating parts 322 are disposed between the first frequency-radiating parts 321.

The conductivity element 33 has a conductivity body 331 and a ground conductor 332. The conductivity body 331 and the ground conductor 332 are electrically connected with the first electrically connecting part 313 and the second electrically connecting part 323, respectively. In this embodiment, the conductivity body 331 is electrically connected with the first electrically connecting part 313, and the ground conductor 332 is electrically connected with the second electrically connecting part 323. Alternatively, the conductivity body may be electrically connected with the second electrically connecting part, and the ground conductor may be electrically connected with the first electrically connecting part (not shown). In this embodiment, the conductivity element 33 is a coaxial line. The conductivity body 331 is used as the core conductor of the coaxial line, and the ground conductor 332 is used as the external ground conductor of the coaxial line. Moreover, the connecting ways of the conductivity element 33 with the first radiating body 31 and second radiating body 32 may change based on the shape of the application products. It is the only concerned rule that the conductivity body and the ground conductor are electrically connected with the first electrically connecting part and the second electrically connecting part, respectively.

In this embodiment, the first electrically connecting part 313 further includes a first feeding point 41, and the second electrically connecting part 323 further includes a second feeding point 42. The conductivity body 331 of the conductivity element 33 and the ground conductor 332 of the conductivity element 33 are electrically connected with the first feeding point 41 and the second feeding point 42, respectively.

Figure 3:
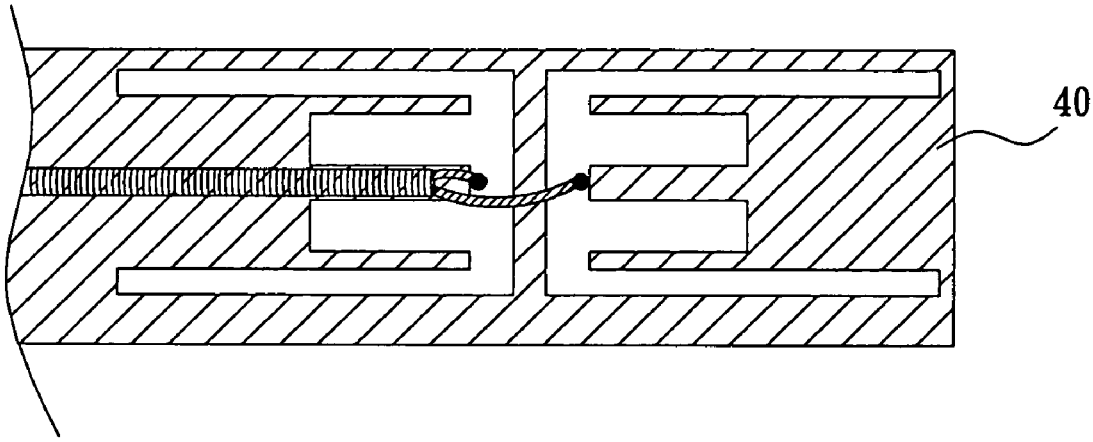
FIG. 3 is a schematic diagram showing the dual band and broad band flat dipole antenna according to the embodiment of the invention, which is disposed on a substrate.

Referring to FIG. 3, in this embodiment, the first radiating body 31 and the second radiating body 32 of the dual band and broadband flat dipole antenna 3 may be made of metal sheets. They may be disposed on a substrate 40 by printing or etching technology. The substrate 40 may be a printed circuit board (PCB), which is made of Bismaleimide-triazine (BT) resin or Fiberglass reinforced epoxy resin (FR4). Furthermore, the substrate 40 may be a flexible film substrate, which is made of polyimide. In some cases, the substrate 40 may be integrated into parts of the whole circuit to decrease the occupied space. In addition, the substrate 40 may be disposed on a surface of a case (not shown), which is for the application product with the dual band and broadband flat dipole antenna 3, by utilizing evaporation deposition technology or other technologies.

Figure 4:
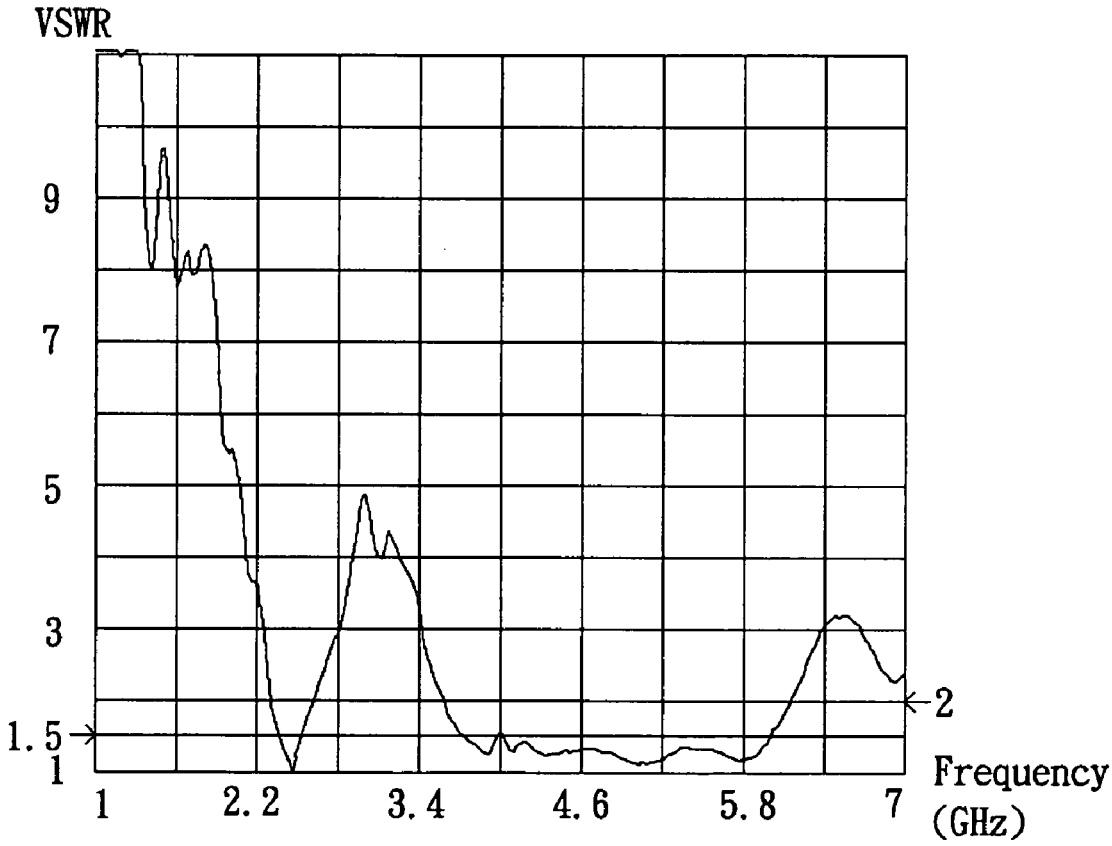
FIG. 4 is a measure diagram showing a working range of bandwidth of the dual band and broadband flat dipole antenna according to the embodiment of the invention.

Referring to FIG. 4, the vertical axis represents the voltage standing wave ratio (VSWR), and the horizontal axis represents the frequency. Obeying the definition of the VSWR, which should be smaller than 1.5, in this embodiment, the first frequency radiating parts 311 and 321 work at 2.4 GHz to 2.5 GHz, and the second frequency radiating parts 312 and 322 work at 4.9 GHZ to 6 GHz. In general, the acceptable definition of the VSWR is, however, about 2. Therefore, if obeying the definition of the VSWR, which is smaller than 2, the dual band and broadband flat dipole antenna 3 of this embodiment can work at broader range of frequency band.

As mention above, the dual band and broadband flat dipole antenna of the invention utilizes the first frequency-radiating parts and the second frequency-radiating parts to achieve the function of dual band and to achieve the function of broadband according to the structure and the configuration of the first radiating body and the second radiating body. Therefore, the usable range of bandwidth of the application products with the antenna of the invention is broadened, so that the application products with the antenna can be used in more countries.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dual band and broadband flat dipole antenna, comprising:

a first radiating body, which has at least two first frequency-radiating parts, at least two second frequency-radiating parts, and a first electrically connecting part, wherein the first frequency-radiating parts of the first radiating body and the second frequency-radiating parts of the first radiating body are extended from a side of the first electrically connecting part, and the second frequency-radiating parts of the first radiating body are disposed between the first frequency-radiating parts of the first radiating body;

a second radiating body, which has at least two first frequency-radiating parts, at least two second frequency-radiating parts, and a second electrically connecting part, wherein each of the first frequency-radiating parts of the first radiating body and the second radiating body has a first length and a first width, each of the second frequency-radiating parts of the first radiating body and the second radiating body has a second length and a second width, the first frequency-radiating parts of the second radiating body and the second frequency-radiating parts of the second radiating body are extended from a side of the second electrically connecting part with a direction reversing to an extending direction of the first radiating body, and the second frequency-radiating parts of the second radiating body are disposed between the first frequency-radiating parts of the second radiating body; and a conductivity element, which has a conductivity body and a ground conductor, wherein the conductivity body and the ground conductor are electrically connected with the first electrically connecting part and the second electrically connecting part, respectively.

2. The antenna according to claim 1, wherein the first frequency-radiating part is rectangular.

3. The antenna according to claim 1, wherein the second frequency-radiating part is a rectangular.

4. The antenna according to claim 1, which is disposed on a substrate.

5. The antenna according to claim 1, wherein the second width is greater than or equal to twice of the first width.

6. The antenna according to claim 1, wherein the first length is between one and three times of the second length.

7. The antenna according to claim 1, wherein the first frequency-radiating part is worked at the frequencies of 2.4 GHz to 2.5 GHz.

8. The antenna according to claim 1, wherein the second frequency-radiating part is worked at the frequencies of 4.9 GHz to 6 GHz.

9. The antenna according to claim 1, wherein the conductivity element is a coaxial line.

10. The antenna according to claim 1, wherein the first electrically conductor further comprises a first feeding point, and the feeding point is electrically connected with the conductivity body or the ground conductor.

11. The antenna according to claim 1, wherein the second electrically conductor further comprises a second feeding point, and the feeding point is electrically connected with the conductivity body or the ground conductor.

* * * * *